US005679297A

United States Patent [19]

Hwang

[11] Patent Number: 5,679,297

[45] Date of Patent: Oct. 21, 1997

[54] METHOD OF MAKING REINFORCED INTERMETALLIC-MATRIX COMPOSITES CONTAINING CERAMICS

[76] Inventor: Chii-Shyang Hwang, No.10, alley 91 hane 307 sahw Don R.D., Taipei, Taiwan

[21] Appl. No.: 494,020

[22] Filed: Jun. 23, 1995

[51] Int. Cl.[6] ..... C04B 40/00; B29C 67/00

[52] U.S. Cl. ..... 264/82; 264/102; 264/125; 264/65; 419/19

[58] Field of Search ..... 264/65, 82, 102, 264/125; 419/19

[56] References Cited

U.S. PATENT DOCUMENTS 4,532,737 8/1985 Moss ..... 51/283 R 4,701,301 10/1987 Kuwahara et al. ..... 419/21

4,999,155 3/1991 Ong et al. ..... 419/2

5,352,522 10/1994 Kugimiya et al. ..... 428/403

*Primary Examiner*—Christopher A. Fiorilla

*Attorney, Agent, or Firm*—Bucknam and Archer

[57] ABSTRACT

A method is described for making reinforced intermetallic matrix composites containing oxide ceramics. The method involves the oxidation of intermetallic powders under optimum conditions in an atmosphere containing oxygen, and the hot-pressed sintering process of oxidized intermetallic powders. The mechanical properties of intermetallic/oxide composites are superior to those of non-oxidized intermetallic sintered bodies.

6 Claims, 8 Drawing Sheets

AES analysis of NiAl powder.(A)untreated (B)oxidized at 700℃,2hr (C)oxidized at 800°C, 2hr (D)oxidized at 1000°C, 2hr

METHOD OF MAKING REINFORCED INTERMETALLIC-MATRIX COMPOSITES CONTAINING CERAMICS

FIELD OF THE INVENTION

The present invention relates to a method of making intermetallic matrix composites having oxide ceramics dispersed therein. The intermetallic matrix may comprise a wide variety of intermetallic materials, with particular emphasis drawn to the aluminides of nickel, NiAl, $Ni_3Al$, $Ni_5Al_3$, $Ni_2Al_3$ and $NiAl_3$. The oxide ceramics may comprise aluminum, nickel or other metal oxides. The method of formation of the intermetallic-matrix composites containing ceramics of the present invention basically involves the oxidation of intermetallic powders under optimum conditions in an atmosphere containing oxygen, followed by the hot-pressed sintering of the oxidized intermetallic powders.

BACKGROUND OF THE INVENTION

Generally, in the method of preparation of metal or intermetallic matrix composites containing ceramics, e.g. ceramic particles or powders as shown in U.S. Pat. No. 4,808,485, U.S. Pat. No. 4,885,212, U.S. Pat. No. 4,999,256 (1989), U.S. Pat. No. 5,079,099 (1992), or ceramic fibers shown in U.S. Pat. No. 3,890,690 (1975), U.S. Pat. No. 4,145,471 (1979), ceramics are added to metal or intermetallic matrix powders and mechanically mixed by ball mill. The mixtures are formed in dense composites by extrusion, pressed-casting, hot-pressing, or hot isostatic pressing. Or ceramic particles are mixed with melted metals, then solidified into bulk composites as shown in U.S. Pat. No. 4,140,170 (1979), U.S. Pat. No. 5,028,392 (1991).

In those composites containing ceramics and intermetallics (or metals) prepared by known methods, because both the ceramics and the intermetallics have different physical properties especially density and thermal expansion coefficient, the ceramics cannot be uniformly dispersed in intermetallic-matrix by the mixing method. Because the residual stress between ceramics and intermetallic is too great, the bonding strength on the interface between two materials in the composites is lowered. These phenomena cause the interface between intermetallics and ceramics to be easily destroyed. Therefore, the mechanical properties of composites are not obviously improved by these known methods.

Some known methods to improve the bonding strength on the interface between ceramics and intermetallic-matrix, as coating an intermediate material on the surface of ceramic fiber or granular by chemical or physical methods are disclosed in U.S. Pat. No. 3,890,690 (1975), U.S. Pat. No. 4,145,471 (1979). With a view to increasing the adhesion of each other, the intermediate materials which must have medium range thermal expansion coefficients are selected. But all those processes of known methods are complicated.

The preparation method of NiAl of nickel aluminide intermetallic compound is explained in this context. NiAl have higher melting point (1638° C.), Young's modulus (189 Mpa), lower density (5.90 kg/m$^3$), and more excellent oxidation resistance than nickel-base alloy (Ram Darolia, JOM, 43 (3), 44–49, 1991). The working temperature of NiAl is higher than that of titanium and nickel-base superalloys. Application of NiAl in the aeronautical and nuclear energy industries shows a certain degree of potential, since operating efficiency of turbine blades manufactured by NiAl should be enhanced.

Recently, some metals such as yttrium, chromium, cobalt, and ceramics Such as powder or fibers of $Al_2O_3$, $TiB_2$, $ZrO_2$ were added to modify the mechanical properties (bending strength and toughness) of nickel aluminide. However, because ceramics and NiAl powders cannot be mixed uniformly and the bonding strength on the interface between ceramics and NiAl is lowered, the mechanical properties of composites could not be obviously improved.

SUMMARY OF THE INVENTION

It is an object of the present invention to provide a method for making reinforced intermetallic-matrix composites containing oxide ceramics. The method involves the oxidation of intermetallic powders under optimum condition in an atmosphere containing oxygen, and the hot-pressed sintering process of oxidized intermetallic powders.

It is a further object of the present invention to produce a reinforced intermetallic matrix composite by a process in which oxide ceramics are uniformly dispersed in intermetallic matrix, so that the object of short production time and high efficient can be achieved.

It is yet a further object of the present invention to alleviate residual thermal stress and enhancement of the interfacial bonding between intermetallics and oxide ceramics, since the concentration gradient of compositions exists between intermetallics and oxide ceramics. Therefore, the mechanical properties of the intermetallic/oxide composites are superior to those of unoxidized intermetallic sintered bodies.

It is also an object for the present invention to produce a sintered composite in which the grain growth of intermetallics and oxide is inhibited, and the bonding strength of these two grains is enhanced since intermetallics and oxides are uniformly dispersed. The results show superior mechanical properties to unoxidized intermetallic sintered bodies.

DETAILED DESCRIPTION OF THE INVENTION

The present invention provides a method for preparing the intermetallic-matrix ceramic composites. The method comprises two steps:

(a) oxidizing the intermetallic compounds powder under an optimum heating rate in an atmosphere containing oxygen, to form a thin and uniform oxide scale on the surface of the intermetallic compound powders, (b) sintering the oxidized intermetallic compound powders by hot-pressing under optimum condition to form an intermetallic-matrix ceramic composite.

An advantage of the present process, in the first step, is that an intermediate layer is formed between the oxide scale and the intermetallic compound powder, which contains the concentration gradient of composition. Therefore, the residual thermal stress is relaxed and the bonding strength of interface between oxide and intermetallic powder increases. In the second step, the grain growth of intermetallic compound and oxide is constrained since oxides are dispersed uniformly in the intermetallic-matrix composite. In this composite, an intermediate layer with the concentration gradient of composition between the oxide and the intermetallic compound also exists. Therefore, the residual thermal stress decreases and the bonding strength increases on the interface between intermetallic compound and oxide, which causes the mechanical properties of the composite to increase.

The instant invention relates to a method of making reinforced intermetallic-matrix composites containing oxide ceramics. The method comprises two steps:

(A) oxidizing intermetallic compound powder at an optimum temperature in an atmosphere containing oxygen, and then (B) sintering by hot-pressing under optimum condition.

Herein is described the oxidation of the intermetallic powders, which is performed at an 1°–10° C./min, oxidation temperature of (0.4–0.7)×Tm, and soaking time of 0–10 hours, in which Tm is the melting point as the absolute temperature of intermetallic powders. The oxidation process is performed in an atmosphere containing oxygen. A thick layer of oxide scale is formed over the surface of the intermetallic powders, the thickness of which is less than 0.1 μm. An intermediate layer with the concentration gradient of composition between oxide scale and intermetallic powders is also formed.

As the intermetallic compound powders are oxidized under the optimum condition, two phenomena described hereinbelow can make the bonding strength of interface between oxide and intermetallics decrease, and can make the oxide scale spall or flake. (i) The diffusion rate of metallic ions, which diffuse from bulk to surface of composites, and the oxidation rate of intermetallic compounds increase with increasing oxidation temperature making the thickness of oxide scale and thermal stress increase, and oxide scale crystallizes simultaneously, (ii) The voids diffuse from surface to bulk of composite. The larger voids can be formed by concentrating the voids on the interface between oxide scale and composites.

In the following step, the oxidized intermetallic powders are sintered at an optimum condition. The sintering temperature must satisfy (0.6–0.9)×Tm, in which Tm is the melting point as the absolute temperature of intermetallic compound. The soaking time is 0–2 hours. The pressure of 10–40 MPa hot-pressing is applied and the sintering process is performed in an atmosphere containing air, vacuum, argon or nitrogen gas.

To avoid decomposition of oxide scale or formation of the other compound, the sintering process is carried out at an optimum sintering atmosphere. For example an atmosphere of vacuum, argon, or nitrogen is used and an oxygen atmosphere is not used for the sintering process under the furnace of graphite heating elements. To obtain composite of dense sintered bodies, the optimum sintering temperature, soaking time, and pressure of hot-pressing will be selected. Higher sintering temperature, longer soaking time will induce grain growth, and will cause the mechanical properties of the composite to decrease.

The nickel aluminide intermetallic compounds involve NiAl, $Ni_3Al$, $Ni_5Al_3$, $Ni_2Al_3$, $NiAl_3$. From the date of thermodynamic free energy, we know that Al in the nickel aluminide intermetallic compound reacts more easily with oxygen to form oxide than Ni. Therefore, the oxide scale formed from the oxidation of intermetallic compound is a $Al_2O_3$ rich layer. NiAl is selected as an example to illustrate the steps in accordance with the present invention.

BRIEF DESCRIPTION OF THE DRAWINGS

FIG. 4(A) unoxidated Ni Al powder;

FIG. 4(B) oxidized NiAl powder at 700° C. for 2 hours;

FIG. 4(C) oxidized NiAl powder at 800° C. for 2 hours;

FIG. 4(D) oxidized NiAl powder at 1000° C. for 2 hours;

EXAMPLE

Figure 5:
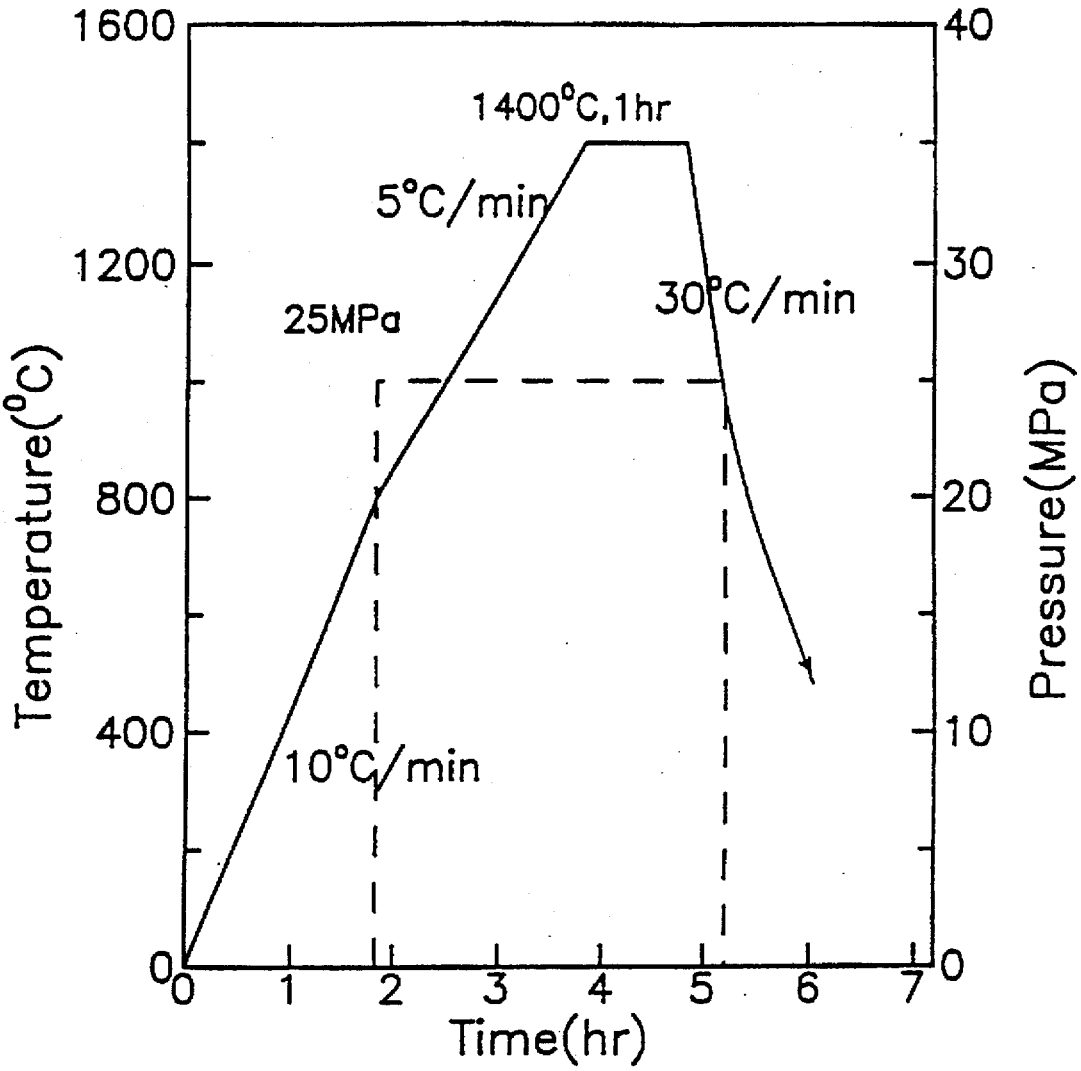
FIG. 5 shows heating rate and pressure curve of sintering process by hot-pressing for NiAl powders.

The present invention discloses a method of preparation of intermetallic-matrix composite, particularly the NiAl powders as raw material with average particle size 12.8 μm. The NiAl powders are oxidized under optimum heating conditions with heating rate of 2° C./min. up to 700°–1000° C. for 0–4 hours. The oxidized NiAl compound powders, i.e. $NiAl/Al_2O_3$ composite powders, are put into the graphite mold, then pushed into the hot-pressing furnace. A dense sintered body of $NiAl/Al_2O_3$ composite is obtained by heating at 1400° C./1 h and $10^{-1}$–$10^{-2}$ Pa. FIG. 5 shows the relationship between heating rate and pressure curve during the sintering process. The mechanical pressure formed by graphite shaft in the sample is 25 MPa.

Figure 1:
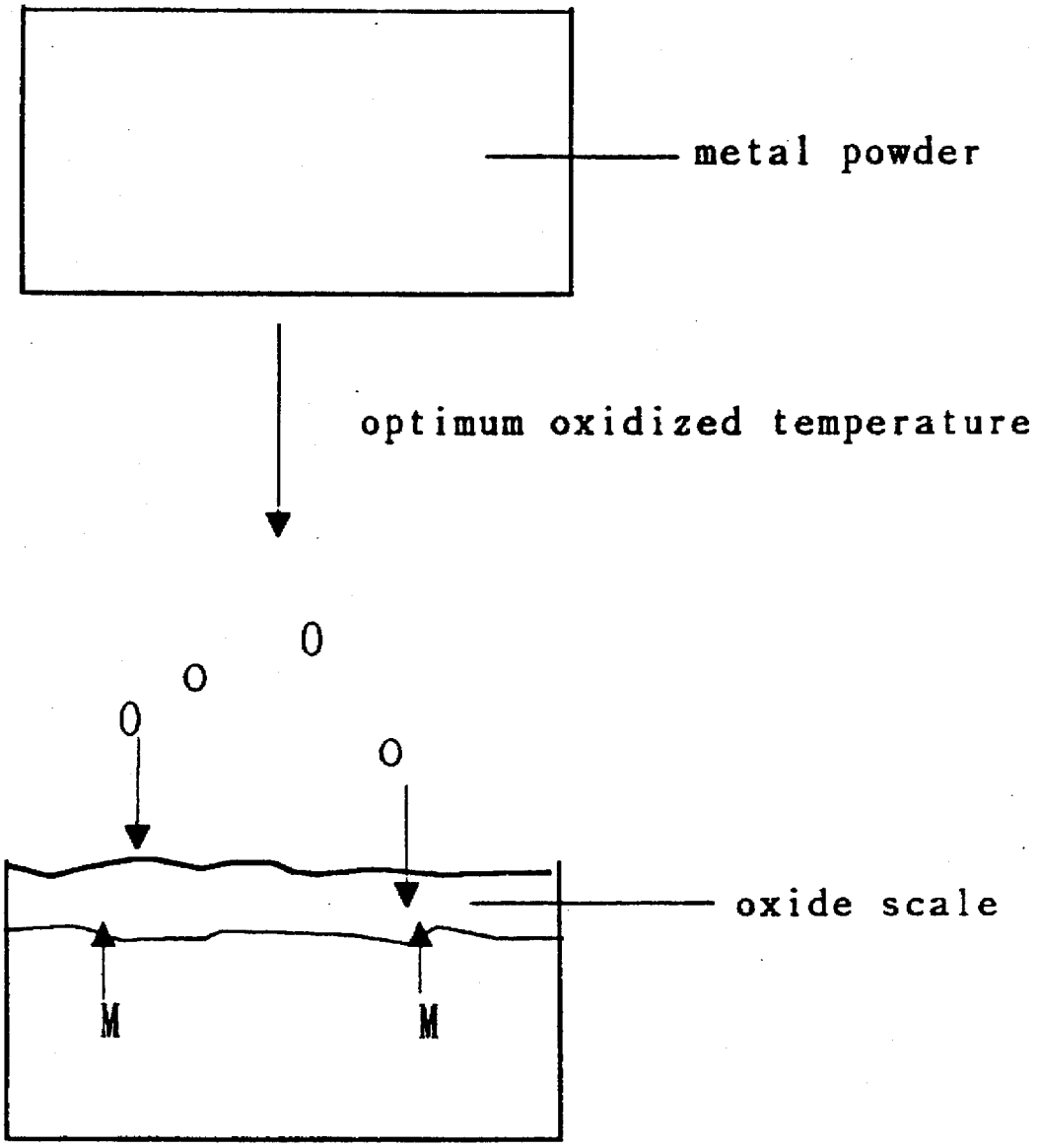
FIG. 1 shows a thin and optimum-thickness scale of oxide formed on the surface of intermetallic powder with oxidation treatment at an optimum temperature.

As NiAl powders are oxidized at 700°–800° C. for 0–4 hours in air, the thin oxide scale is formed on the surface of the NiAl particle by the reaction of NiAl and oxygen. The oxide scale is coated tightly on the surface of NiAl particle as shown in FIG. 1. Results of TEM analysis show that the oxide scale is composed of amorphous and microcrystalline alumina. The thickness of the oxide scale which is less than 0.1 μm depends on the oxidation temperature and soaking time.

Figure 2:
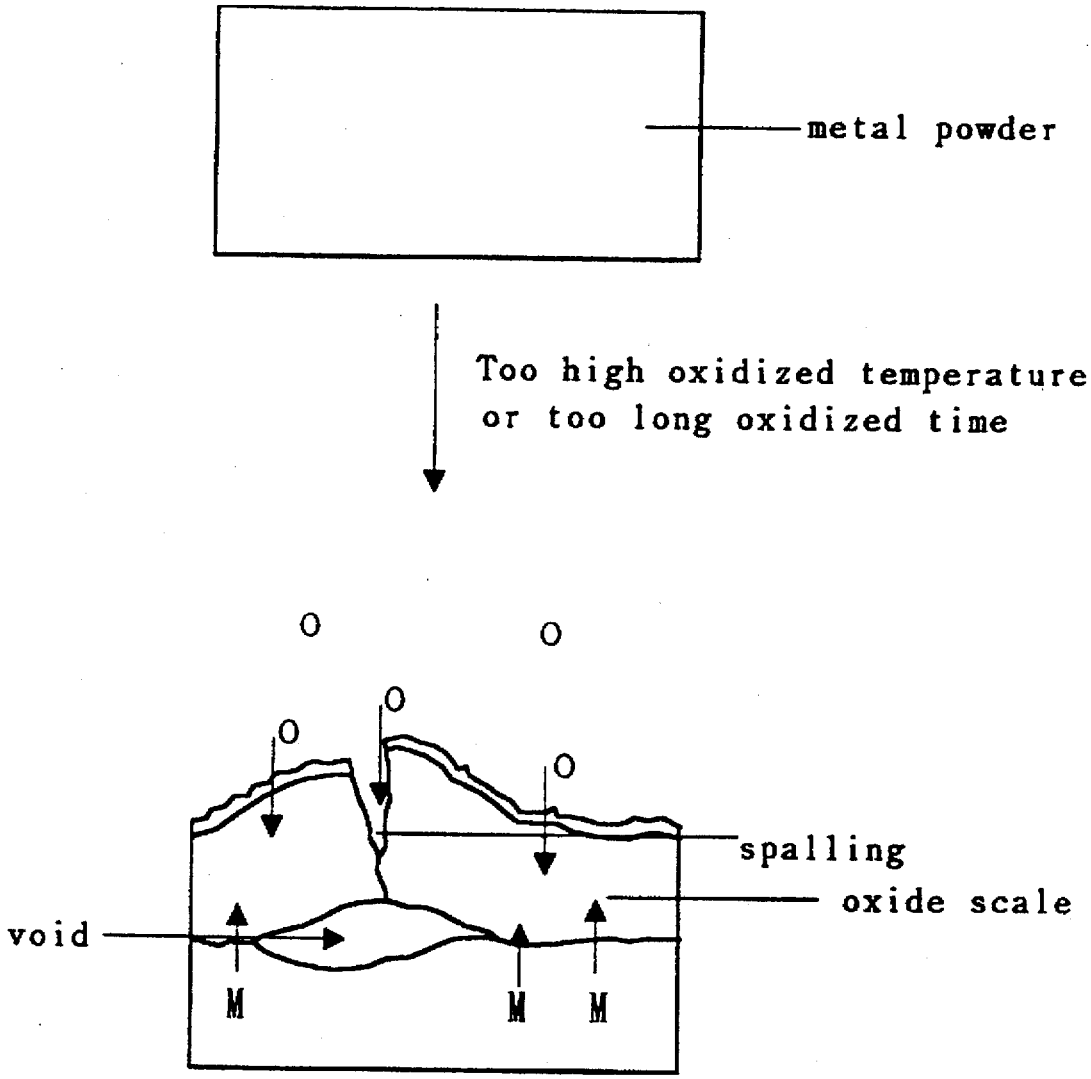
FIG. 2 shows the thick scale of oxide broken up on the surface of intermetallic powder with oxidation treatment at higher temperature.

As NiAl powders are oxidized at higher temperature of 1000° C. for 0–4 hours, the oxide scale formed on the surface of the NiAl particle is too thick and breaks up partly (FIG. 2). The oxide scale is crystalline with $Al_2O_3$ and NiO. The residual stress is formed on the interface of NiAl and oxide scale, since the difference of thermal expansion coefficients of NiAl and oxide scale is large and the thickness of oxide scale is more than 0.1 um. On the interface of NiAl and oxide scale, some voids are formed from the accumulation of voids diffusing from the surface of NiAl particle. These voids and residual stress make the interfacial bonding of NiAl and oxide scale decrease. These phenomena cause oxide scale to partly spall or break off.

As NiAl powder is placed at room temperature in air, the oxide scale is not formed as shown in FIG. 1 or FIG. 2.

Figure 3:
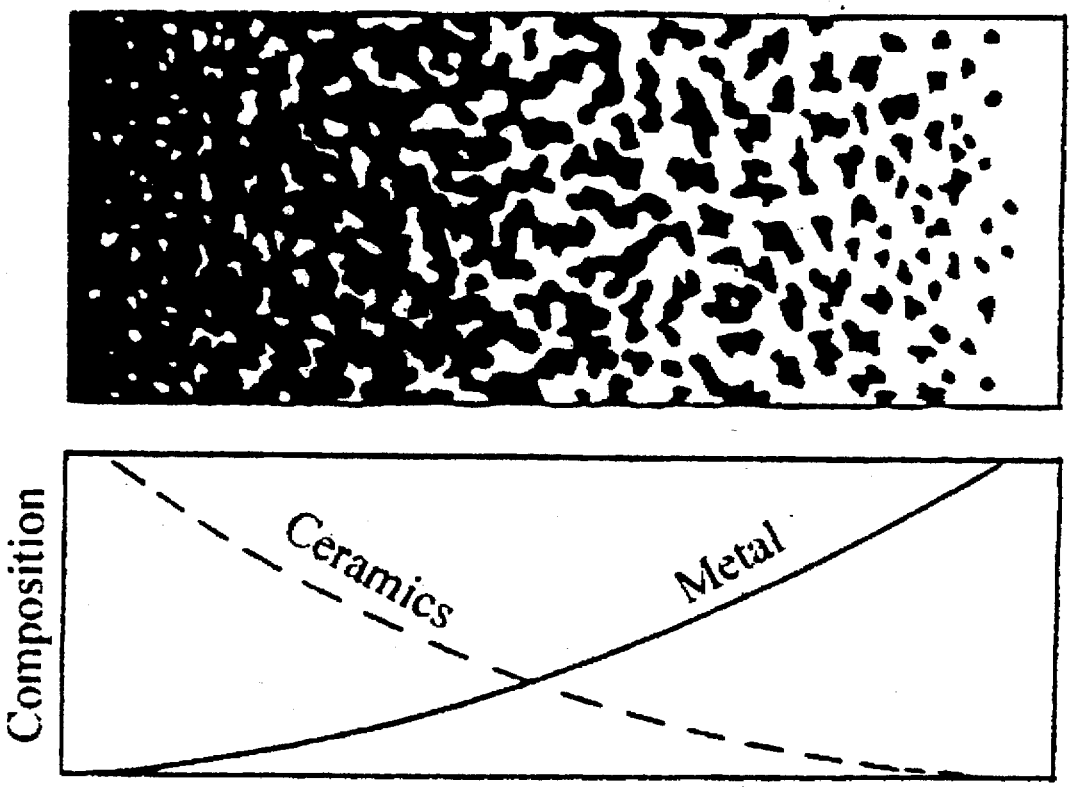
FIG. 3 shows the concentration gradient of composition between intermetallic compound and oxide ceramics with oxidation treatment at an optimum temperature.
Figure 4A:
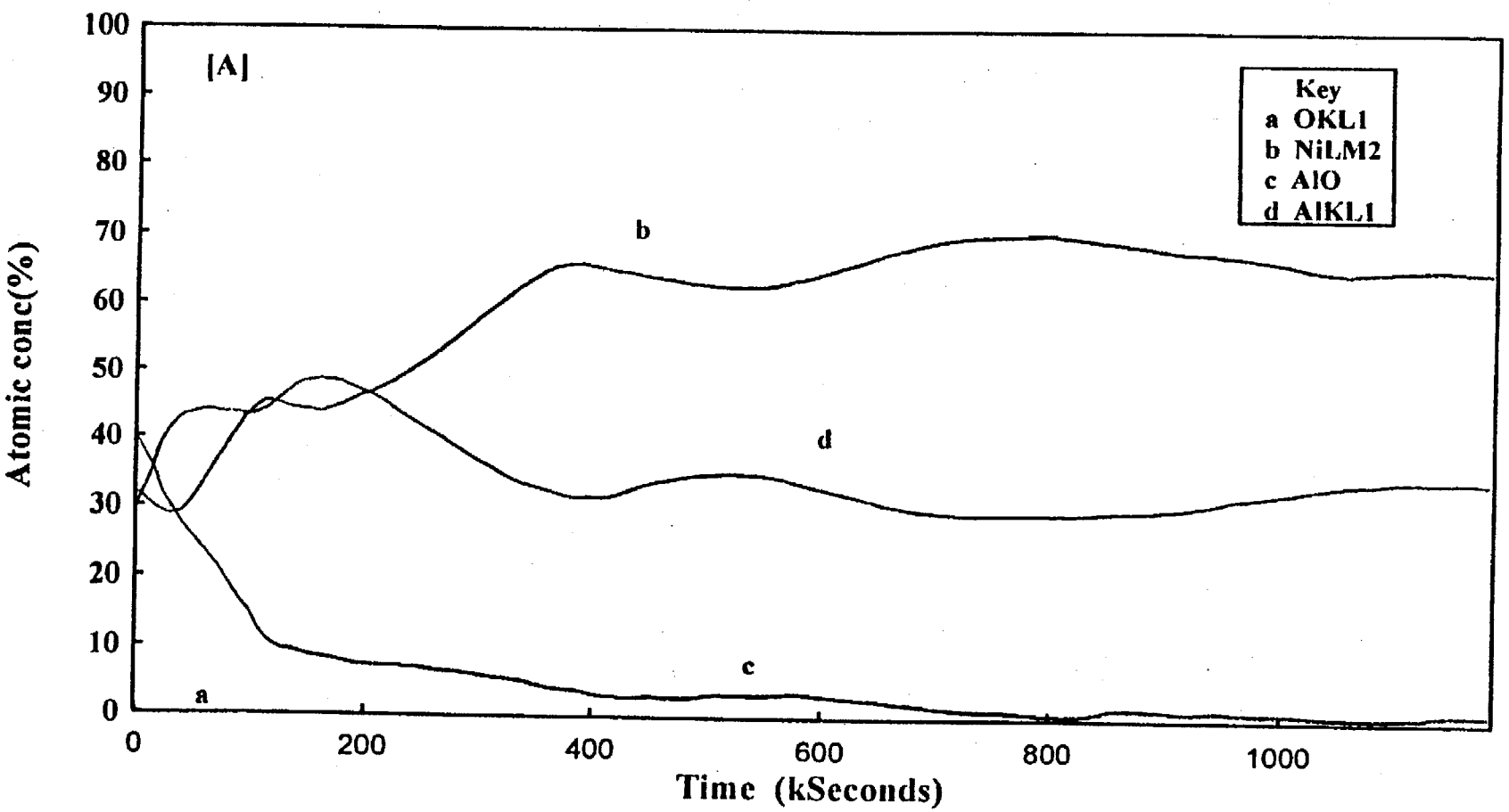
FIGS. 4A–D show the results of AES (Auger electronic spectroscopy) analysis with Ar+ sputtering.
Figure 4B:
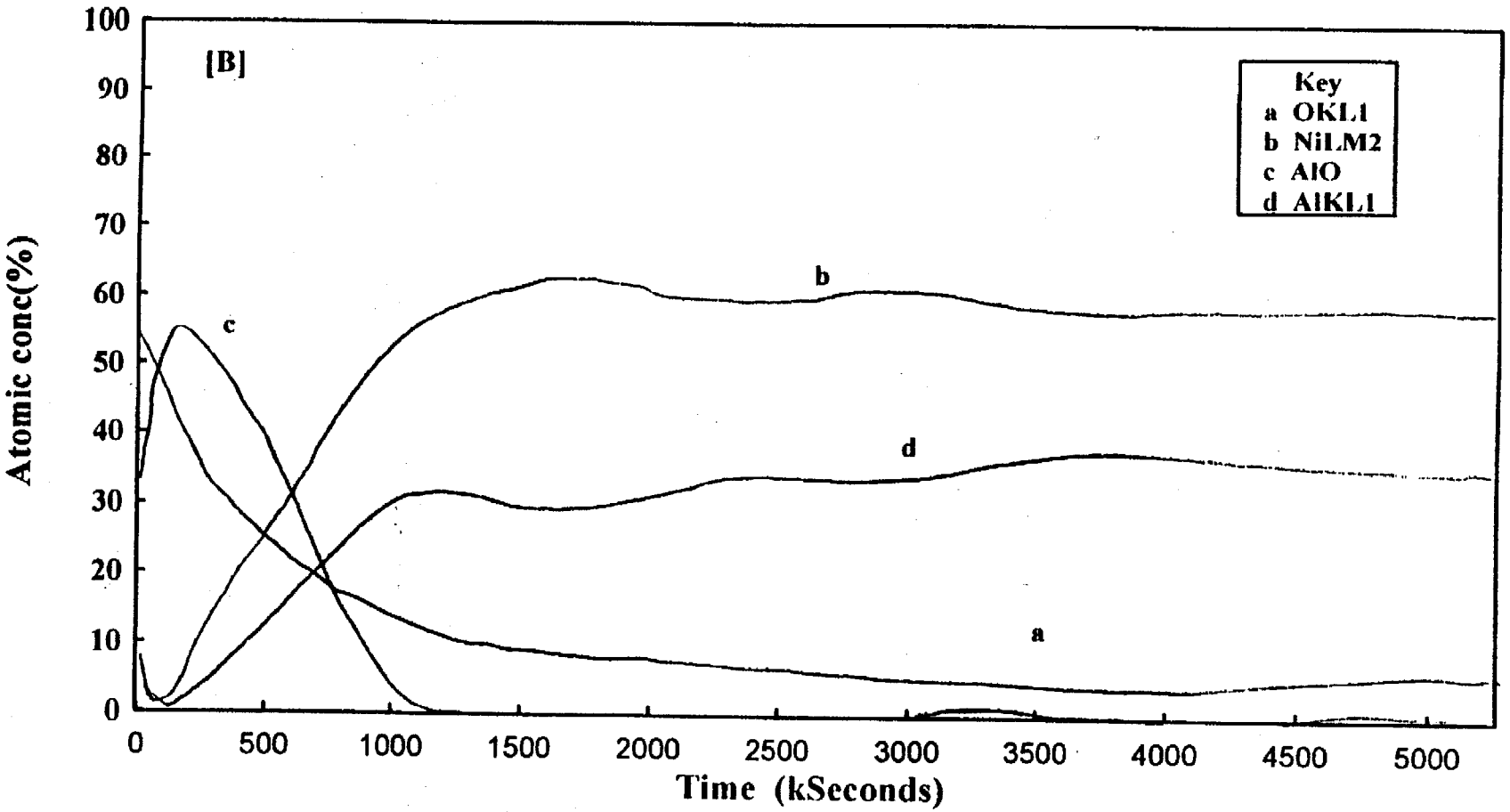
Figure 4C:
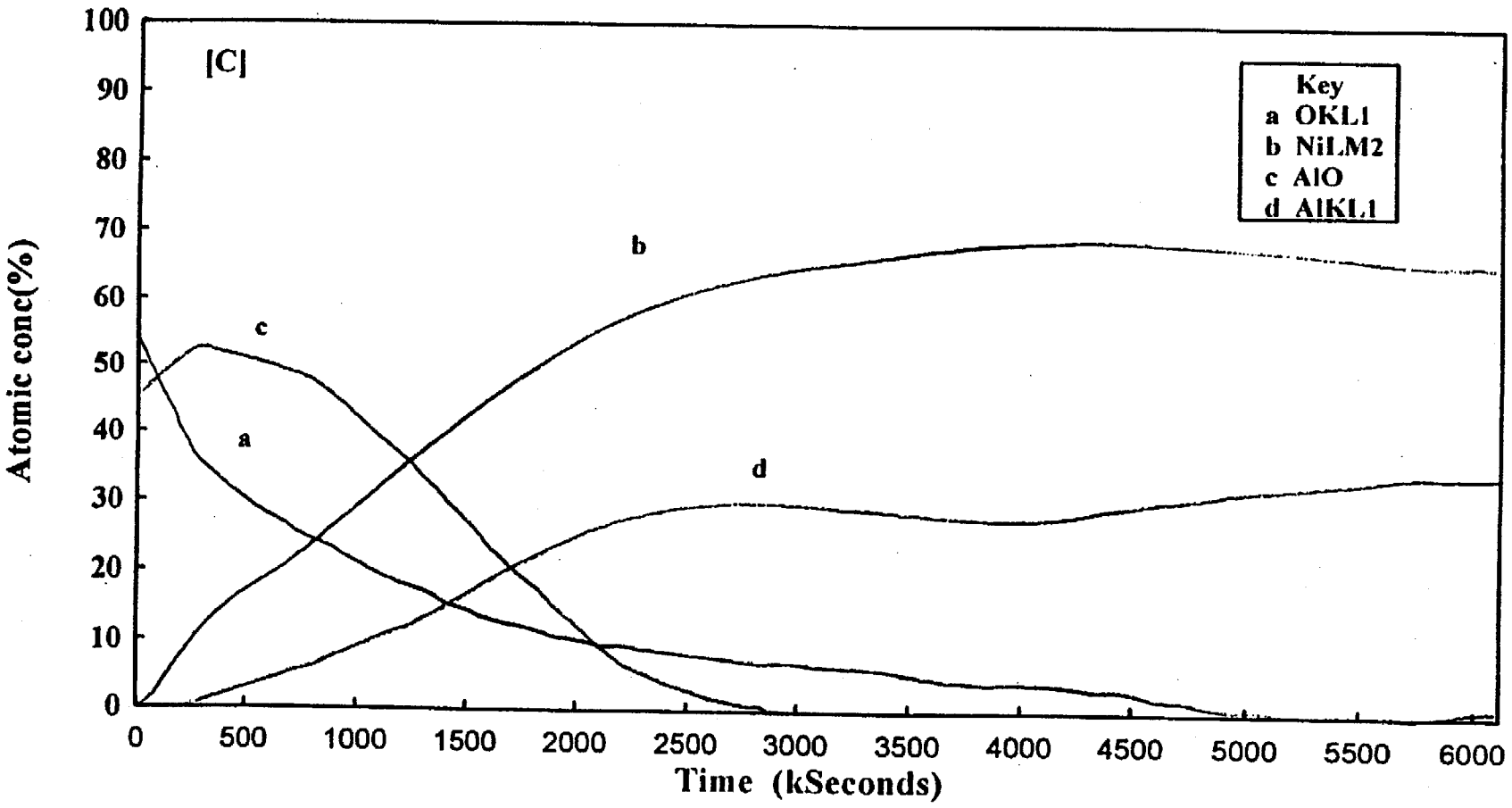
Figure 4D:
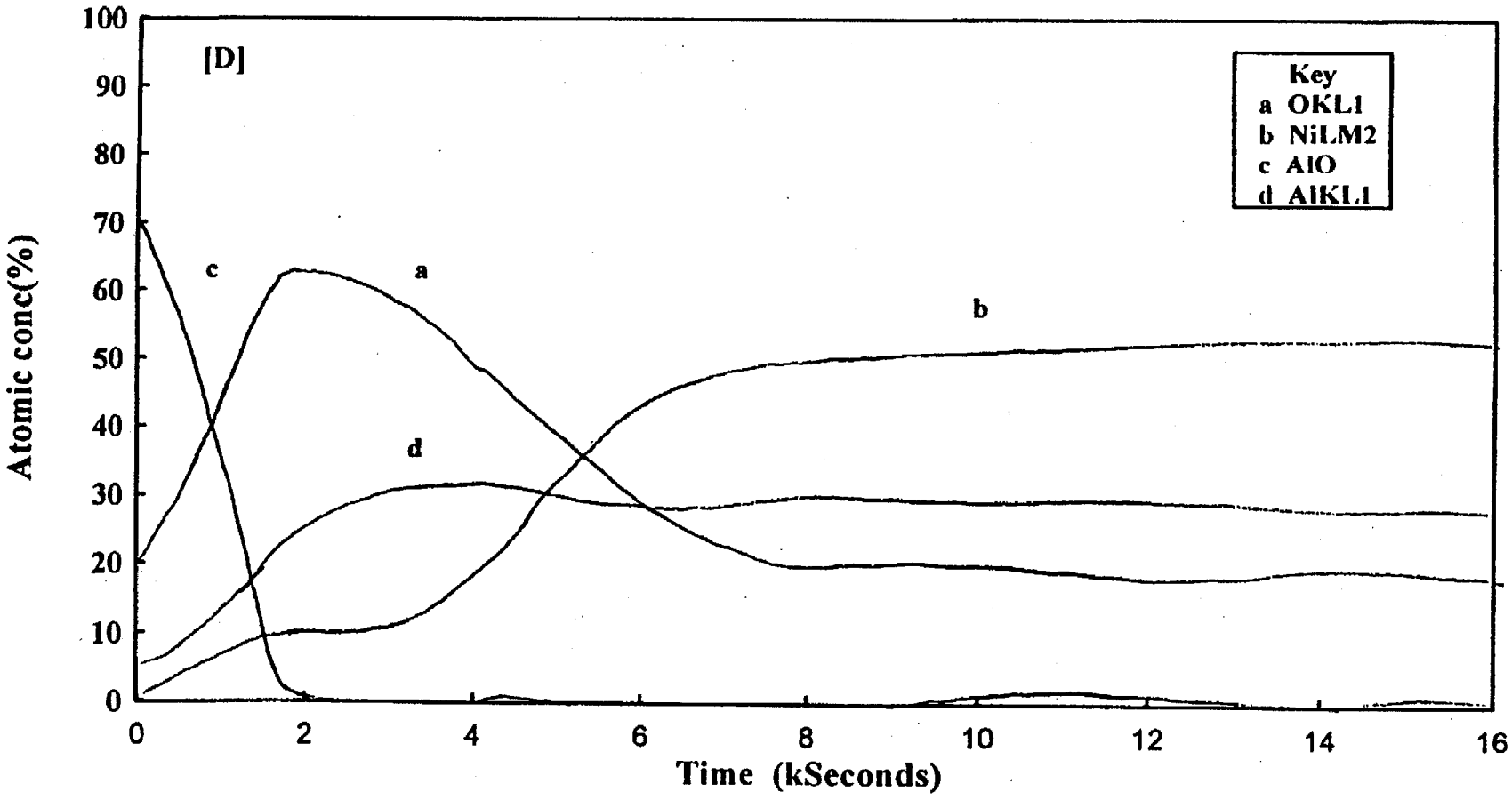

A concentration gradient of composition, as shown in FIG. 3, exists between NiAl and oxide scale when NiAl is oxidized. Results of the AES (Auger electronic spectroscopy) analysis for unoxidized NiAl powder and oxidized NiAl powder at 700°–1000° C. for 2 hours are shown in FIG. 4(A)–FIG. 4(D), respectively. The concentration of Ni and Al atoms in the matrix, measuring from $Ni_{LM2}$ and $Al_{KL1}$ respectively, increase gradually from surface to bulk. The concentration of Al and oxygen atoms in the oxide scale, measuring from $Al_o$ and $O_{KL1}$ respectively, decreases gradually from surface to bulk. The duration time that the concentration gradient of composition on the surface of powder by sputtering with Ar+ ions is a constant value of 300 seconds for unoxidized NiAl sample. The duration time of the oxidized NiAl sample increases with increasing oxidation temperature. The duration time is 1000 seconds and 6000 seconds for NiAl sample oxidized at 700° C./2 hrs and 1000° C./2 hrs, respectively. These results show that the range of the concentration gradient of composition increases with increasing oxidation temperature.

The density in the sintered bodies is measured by the Archimedes' method. The volume content of alumina in the sintered body is measured by image anlysis of SEM photograph of sintered body.

The content of alumina in the sintered body increases with increasing oxidation temperature and oxidation time.

For sintered bodies the atomic concentration distribution is measured by microstructure of TEM and EDS analysis. The results indicate that there is a region of concentration gradient of composition between oxide scale and NiAl grain. The thickness of the region is only 400 nm (see FIG. 3).

The specifications of sintered bodies, is 3×4×40 mm. The three-point bending strength of example bodies described is 7 to 12, i.e. the sintered bodies of example, is measured by CNS 12701-R3162 method in room temperature. The bending strength is the average value of 6–8 samples. For unoxidized sample the bending strength is only 820 MPa, but for the sample oxidized at 700° C. for 4 hrs the bending strength of 1020 MPa is obtained. The bending strength of oxidized sample is about 24% higher than that of unoxidized sample.

The fracture toughness is measured by SENB (single edge notched bending, notched with 0.5 mm-width and ⅓ depth of the sample) method. The toughness value of each sample is the average value of 6–8 specimens. For unoxidized sample the fracture toughness is 12.4 MPam ½, but for the sample oxidized at 700° C. for 4 hrs the toughness value of 15.4 $MPam^{1/2}$ is obtained. The latter value of oxidized sample is about 24% higher than that of unoxidized sample.

The maximum bending strength and fracture toughness of sintered bodies is obtained as the NiAl sample is oxidized at 700° C. for 4 hrs. For the NiAl powder oxidized at 700° C. for 4 hrs, the bonding strength of $NiAl/Al_2O_3$ interface is the greatest because of the optimum thickness of $Al_2O_3$ formed on the surface of NiAl. On the other hand, the residual stress is relaxed, because the concentration gradient of composition on the interface of NiAl and $Al_2O_3$ is decreased. Therefore, the fracture is intragranular in this condition.

As NiAl powder is oxidized at higher temperature (>700° C.), the oxide scale formed on the surface of NiAl is too thick for spalling (shown in FIG. 2), which causes the bonding strength of interface of $NiAl/Al_2O_3$ to decrease. Therefore, the fracture is intergranular in this condition.

The nickel aluminide intermetallic compounds involve NiAl, $Ni_3Al$, $Ni_5Al_3$, $Ni_2Al_3$, $NiAl_3$, and $NiAl_3$. From the data of thermodynamic free energy, we know that these nickel aluminides have similar reaction of oxidation to form oxide scale. Therefore, the bending strength and toughness of these nickel aluminide sintered bodies can be enhanced by an optimum oxidation treatment of nickel aluminide powders.

Obviously, a skilled person would realize that various modifications and variations of the present invention are possible in light of the above teaching. It is therefore to be understood that within the scope of the appended claims of the invention may be practiced otherwise than as specifically described.

What I claim is:

1. A method for preparing intermetallic-matrix composites containing oxide ceramics, particularly utilizing NiAl powders as raw material, comprising the steps of a) oxidizing the NiAl powders at a heating rate of 2° C./min up to 700° to 1000° C. for zero to 4 hours in an atmosphere containing oxygen; and b) sintering the oxidized NiAl powders in a mold in a hot-pressing furnace in a vacuum at 1400° C. for one hour at 10 to 40 MPa.

2. The method as defined in claim 1, wherein the oxidizing temperature in step (a) is 700° C.

3. The method as defined in claim 1, wherein the mold utilized in the sintering step is a graphite mold.

4. The method as defined in claim 1, wherein the NiAl raw material powder has an average particle size of 12.8 um.

5. A method of preparing intermetallic-matrix composites containing oxide ceramics, utilizing NiAl powders as raw material, comprising the steps of a) oxidizing the NiAl powders at a heating rate of 2° C./min up to 700° to 1000° C. for zero to 4 hours in an atmosphere containing oxygen; and b) sintering the oxidized NiAl powders in a mold in a hot-pressing furnace in an atmosphere of argon at 1400° C. for one hour at 10 to 40 MPa.

6. A method of preparing intermetallic-matrix composites containing oxide ceramics, utilizing Nial powders as raw material, comprising the steps of a) oxidizing the NiAl powders at a heating rate of 2° C./min up to 700° to 1000° C. for zero to 4 hours in an atmosphere containing oxygen; and b) sintering the oxidized NiAl powders in a mold in a hot-pressing furnace in an atmosphere of nitrogen at 1400° C. for one hour at 10 to 40 MPa.

* * * * *